US007108257B2

(12) United States Patent
Shiohara et al.

(10) Patent No.: US 7,108,257 B2
(45) Date of Patent: Sep. 19, 2006

(54) SHEET-SUPPLY DEVICE

(75) Inventors: Yukio Shiohara, Nagoya (JP); Takamitsu Kawai, Oobu (JP); Koji Takito, Nisshin (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 172 days.

(21) Appl. No.: 10/394,199

(22) Filed: Mar. 24, 2003

(65) Prior Publication Data

US 2003/0184004 A1 Oct. 2, 2003

(30) Foreign Application Priority Data

Mar. 29, 2002 (JP) ..... 2002-096300

(51) Int. Cl.
*B65H 3/34* (2006.01)
*B65H 3/52* (2006.01)

(52) U.S. Cl. ..... 271/104; 271/121; 271/137; 271/167

(58) Field of Classification Search ..... 271/104, 271/121, 137, 167
See application file for complete search history.

(56) References Cited

U.S. PATENT DOCUMENTS 4,865,306 A 9/1989 Himegi
5,058,877 A 10/1991 Fujiwara et al.
5,775,688 A * 7/1998 Kato et al. ..... 271/167
5,895,039 A * 4/1999 Kato et al. ..... 271/124
5,971,390 A 10/1999 Caspar et al.
6,158,733 A * 12/2000 Muraki ..... 271/127
6,390,463 B1 * 5/2002 Iwago ..... 271/118
6,536,757 B1 * 3/2003 Chang ..... 271/16
2001/0040335 A1 11/2001 Chang
2002/0070495 A1 * 6/2002 Takeuchi ..... 271/121
2004/0017039 A1 * 1/2004 Asada et al. ..... 271/121

FOREIGN PATENT DOCUMENTS

EP 0 281 073 A2 9/1988
EP 0 885 825 12/1998
JP 55-044473 3/1980
JP 10-152239 6/1998
JP A 10-310274 11/1998
JP A 2000-168980 6/2000
JP A 2001-253580 9/2001

* cited by examiner

*Primary Examiner*—Donald P. Walsh
*Assistant Examiner*—Kenneth W. Bower
(74) *Attorney, Agent, or Firm*—Oliff & Berridge, PLC

(57) ABSTRACT

A sheet-supply device supplying sheets one at a time from a stack of sheets in a sheet feeding direction. The device includes a slanting plate on which a stack of sheets is mounted. A sheet feed roller is positioned above the slanting plate applying a force to an uppermost sheet in the stack to move the sheet in a sheet feed direction. A fixed separation plate is fixed at a downstream end portion of the slanting plate. The separation plate is formed with a slot in which a high friction separation member is disposed. The high friction separation member is held by a resilient support plate 39 supported by the fixed separation plate. The resilient support plate has a comb like slats on which the high friction separation member is held. In a normal condition, the high friction separation member protrudes from the slot toward the leading edges of the sheets. When a leading edge of the sheet presses the high friction separation member by the rotation of the sheet feed roller, and the sheet has a predetermined stiffness, a part of the high friction separation member sinks into the slot by the deformation of the comb like slats.

23 Claims, 13 Drawing Sheets

SHEET-SUPPLY DEVICE

BACKGROUND OF THE INVENTION

The present invention relates to a sheet-supply device for supplying cut sheets and to an image forming device provided with the sheet-supply device.

Recently, image forming device such as laser printers, color ink jet printers, facsimile machines, and copy machines, are provided with a sheet-supply device that supplies one cut sheet at a time to an image forming section of the image forming device. U.S. Pat. No. 6,158,733 and Japanese Patent Application Publication Nos. 2001-253580 and 2000-168980 disclose sheet-supply devices that include a slanting tray plate, a separation plate, and a sheet-supply roller. A plurality of sheets is stacked on the tray plate. The sheet-supply roller is provided in confrontation with the tray plate and supplies sheets downstream in a sheet-supply direction. The separation plate is disposed downstream from the tray plate in the sheet-supply direction. The separation plate has a separation slanted surface that extends in a direction that forms an obtuse angle with respect to the surface of the tray plate.

In one known sheet-supply device, the separation plate is modified such that the separation plate is formed with a slot extending in the direction in which the separation slanted surface extends. A high-friction insert member provided with a protruding part is fitted into the slot from the under side of the separation plate so that the protruding part is directed upwardly. The high-friction insert member is made from polyurethane resin. A foam-rubber member is provided at a lower surface of the high friction insert member for resiliently supporting the high-friction insert member.

The sheets stacked on the tray plate are supported with their leading edges, i.e., downstream-side (with respect to the direction of sheet supply) edges in abutment with the protruding part that protrudes from the surface of the separation plate. When the sheet-supply roller is driven to rotate while pressed against the uppermost sheet in the stack on the tray plate, then the leading edge of the sheet presses against the protruding part of the high-friction insert member. Therefore, the protruding part is resiliently deformed and sinks into the slot from the surface of the separation plate. As a result, the leading edge of the sheet is released from the high friction resistance of the high-friction insert member and so slides across the surface of a separation plate having a coefficient of friction lower than that of the high friction insert member, so that one sheet at a time is separated from the stack.

However, the separation plate is made completely from a synthetic resin in a block shape. Therefore, changes in temperature, humidity, or other environmental conditions, or in forming conditions, may change Young's modulus and friction coefficient of the synthetic resin. Thus, sheet separation ability varies with the season of the year, so that sometimes two sheets are fed out at the same time.

SUMMARY OF THE INVENTION

It is an object of the present invention to overcome the above-described problems and provide a sheet supply device capable of reliably separating and supplying sheets.

Another object of the present invention is to provide an image forming device provided with the improved sheet supply device.

These and other objects of the present invention will be attained by a sheet-supply device for supplying sheets one at a time from a stack of sheets in a sheet feeding direction, the sheet-supply device including a sheet supporting member, a sheet feed unit, a guide member, a high friction member, and a resilient support member. The sheet supporting member is adapted for supporting the stack of sheets. The sheet feed unit applies a force to a sheet in the stack to move the sheet in the sheet feed direction. The guide member is disposed at a downstream side of the sheet supporting member with respect to the sheet feed direction. The guide member has a guide surface that guides the sheet in a guide direction. The high friction member extends in the guide direction and is disposed in the guide member. The high friction member has a separation surface exposed through the guide surface so that the stack of sheets supported by the sheet supporting surface abuts against the separation surface. The resilient support member supports the high friction member and allows the separation surface to protrude from and retract into the guide surface depending on the force provided by the sheet feed unit.

BRIEF DESCRIPTION OF THE DRAWINGS

In the drawings:

FIG. 8(*b*) is a cross-sectional view taken along line VIIIb—VIIIb of FIG. 8(*a*);

FIG. 8(*c*) is a cross-sectional view taken along line VIIIc—VIIIc of FIG. 8(*a*);

FIG. 9(*b*) is a frontal view partially in cross-section showing the base block of FIG. 9(*a*);

FIG. 9(*c*) is a side view partially in cross-section showing the base block of FIG. 9(*a*);

is

FIG. 11(*b*) is a magnified cross-sectional view taken along line XIb—XIb of FIG. 11(*a*);

FIG. 11(*c*) is a magnified cross-sectional view showing a friction separation member of the fixed separation unit;

FIG. 12(*b*) is a side view showing sheet separation operations of the sheet-supply device of FIG. 2 when sheets have a high stiffness;

DETAILED DESCRIPTION OF THE EMBODIMENT

Figure 1:
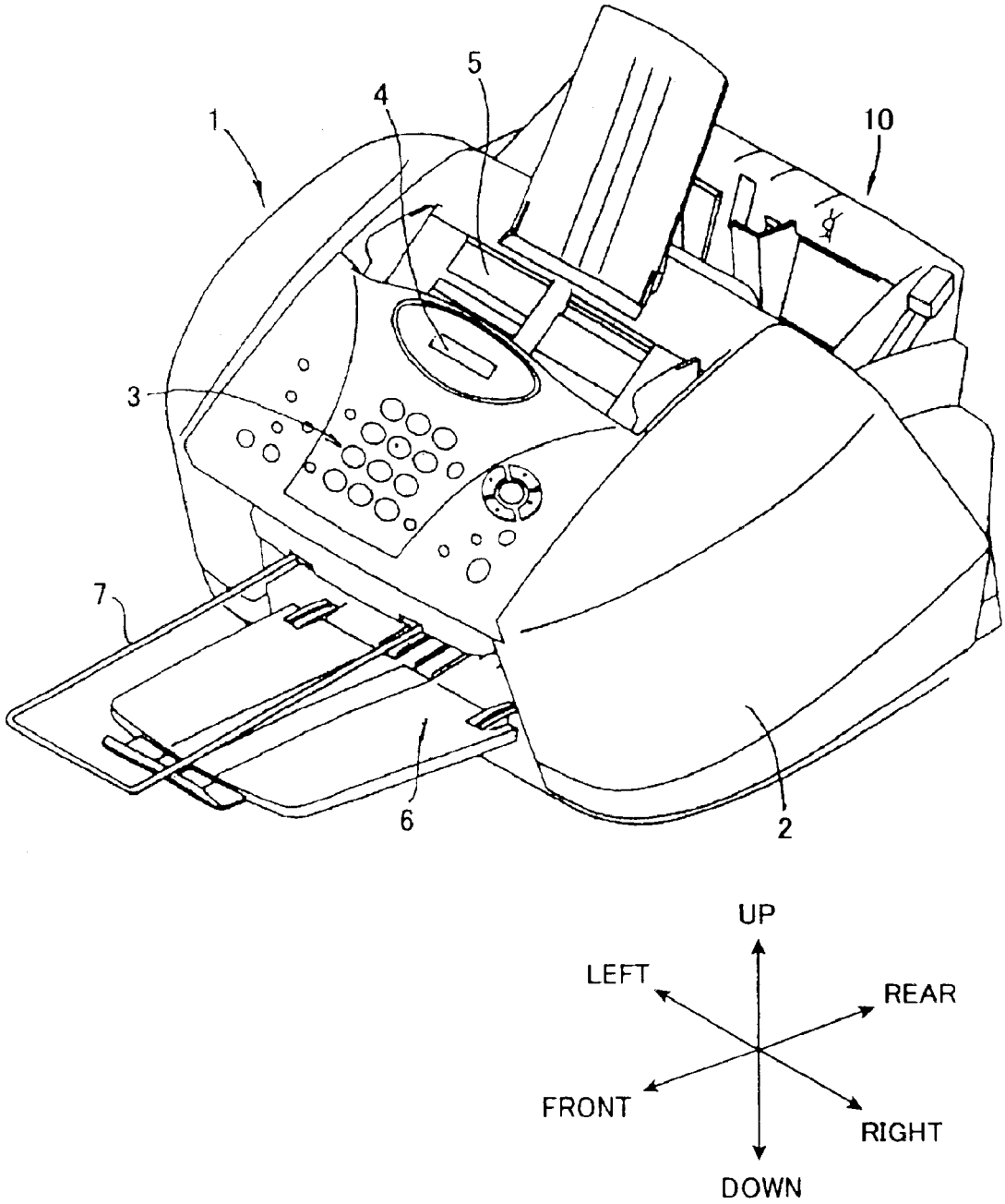
FIG. 1 is a perspective view showing a multifunction image forming device according to a first embodiment of the present invention.

Next, a multifunction image forming device 1 mounted with a sheet-supply device 10 according to a first embodiment of the present invention will be described while referring to the accompanying drawings. In the following description, directional terms such as up, down, left, right, front, and rear will be used assuming that the multi-function image forming device 1 is in the orientation in which it is intended to be used as shown in FIG. 1. The multi-function image forming device 1 includes a facsimile function, a printer function, a copy function, and a scanner function.

As shown in FIG. 1, the multi-function image forming device 1 includes a box-shaped casing 2, an operation panel 3, a document tray 5, a sheet discharge tray 6, a document discharge tray 7, and a sheet-supply device 10. Although not shown in the drawings, the multi-function image forming device 1 also includes a scanner and an image forming unit disposed inside the casing 2. The image forming section is a color ink jet type printing engine in the present embodiment.

The operation panel 3 is disposed on the upper surface of the casing 2. The operation panel 3 includes a plurality of buttons and a liquid crystal display (LCD) 4. The buttons include "0" to "9" number buttons, a start button, and a function operation button. The user can input various information and commands, such as selecting the suitable function, by pressing these buttons. The liquid crystal display 4 is disposed at the rear portion of the operation panel 3 and is for displaying the settings of the image forming device 1 and various operation messages. The document tray 5 is disposed behind the liquid crystal display 4 and the sheet-supply device 10 is provided to the rear of the document tray 5. The discharge trays 6, 7 are provided at the front of the casing 2 at a position below the operation panel 3.

The document tray 5 is for holding a document to be transmitted to a remote facsimile machine using the facsimile function or a document to be copied using the copy function. In either case, the document on the document tray 5 is fed to the scanner (not shown) one sheet at a time. The scanner scans each sheet and retrieves an image that corresponds to the image on the sheet. After image retrieval, the sheets of the document are discharged onto the document discharge tray 7.

The sheet-supply device 10 is for holding a plurality of sheets P (FIG. 4) in a stack. The sheets P are used when printing an image using the copy function or images received in a data transmission from a remote facsimile machine. The sheet-supply device 10 supplies the sheets P one at a time to the image forming section (not shown) in the casing 2. After the image forming section prints images on a sheet, the sheet is discharged onto the sheet discharge tray 6.

Figure 2:
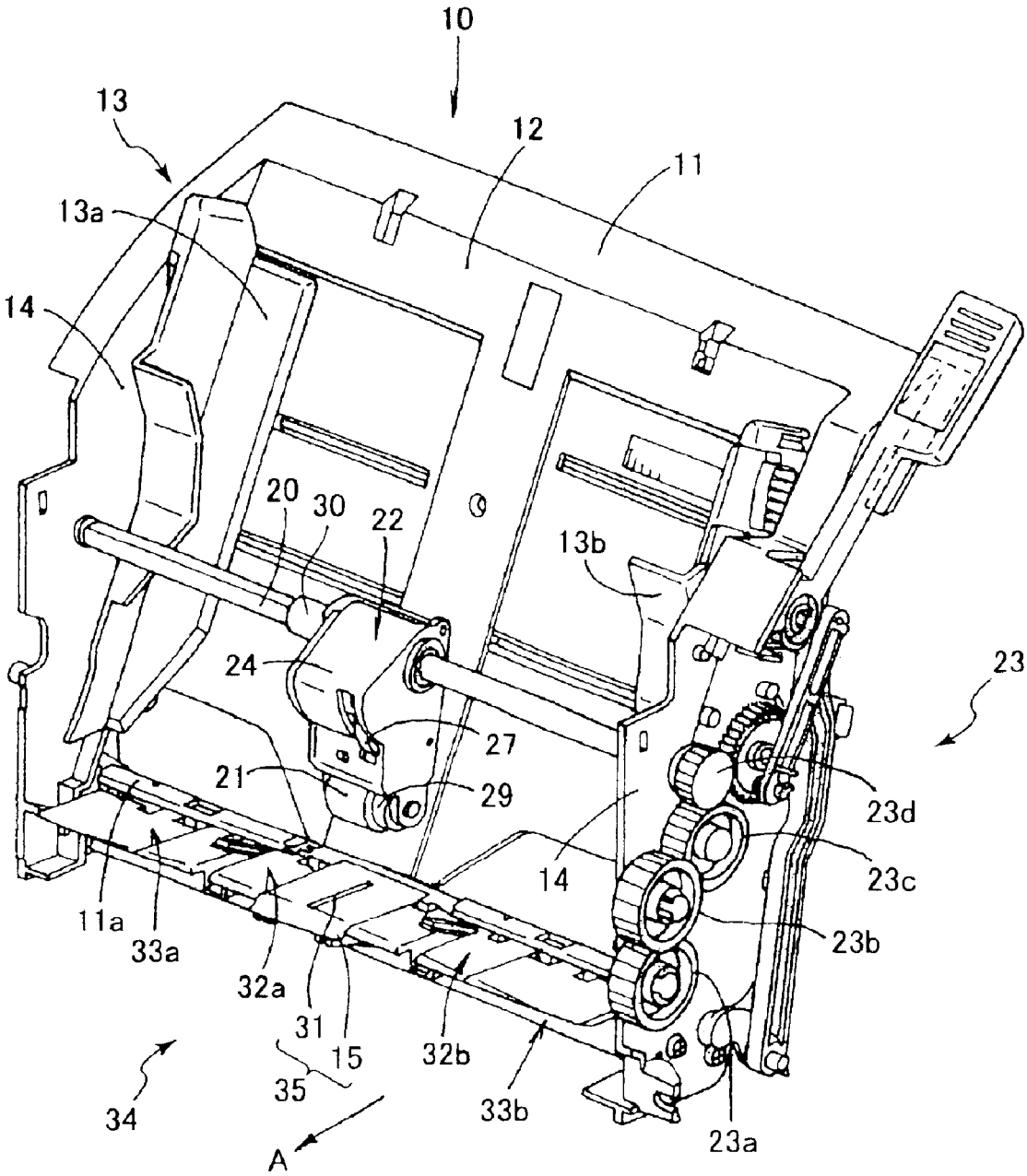
FIG. 2 is a perspective view showing a sheet-supply device of the multifunction image forming device of FIG. 1.

Next, the sheet-supply device 10 will be described in further detail. As shown in FIG. 2, the sheet-supply device 10 includes a frame 11, a sheet guide unit 13, a sheet-supply roller unit 22, a gear train 23, and a sheet separation section 34. The frame 11 includes a slanting plate 12 and a pair of side wall plates 14, 14. The slanting plate 12 and the side wall plates 14, 14 are all formed integrally from a synthetic resin, with the side wall plates 14, 14 connected integrally to left and right sides of the slanting plate 12. The slanting plate 12 slants downward and forward and is capable of supporting a plurality of sheets P in a stack. It should be noted that sheets P are supported on the slanting plate 12 with their widthwise direction extending in the left-right direction.

Figure 4:
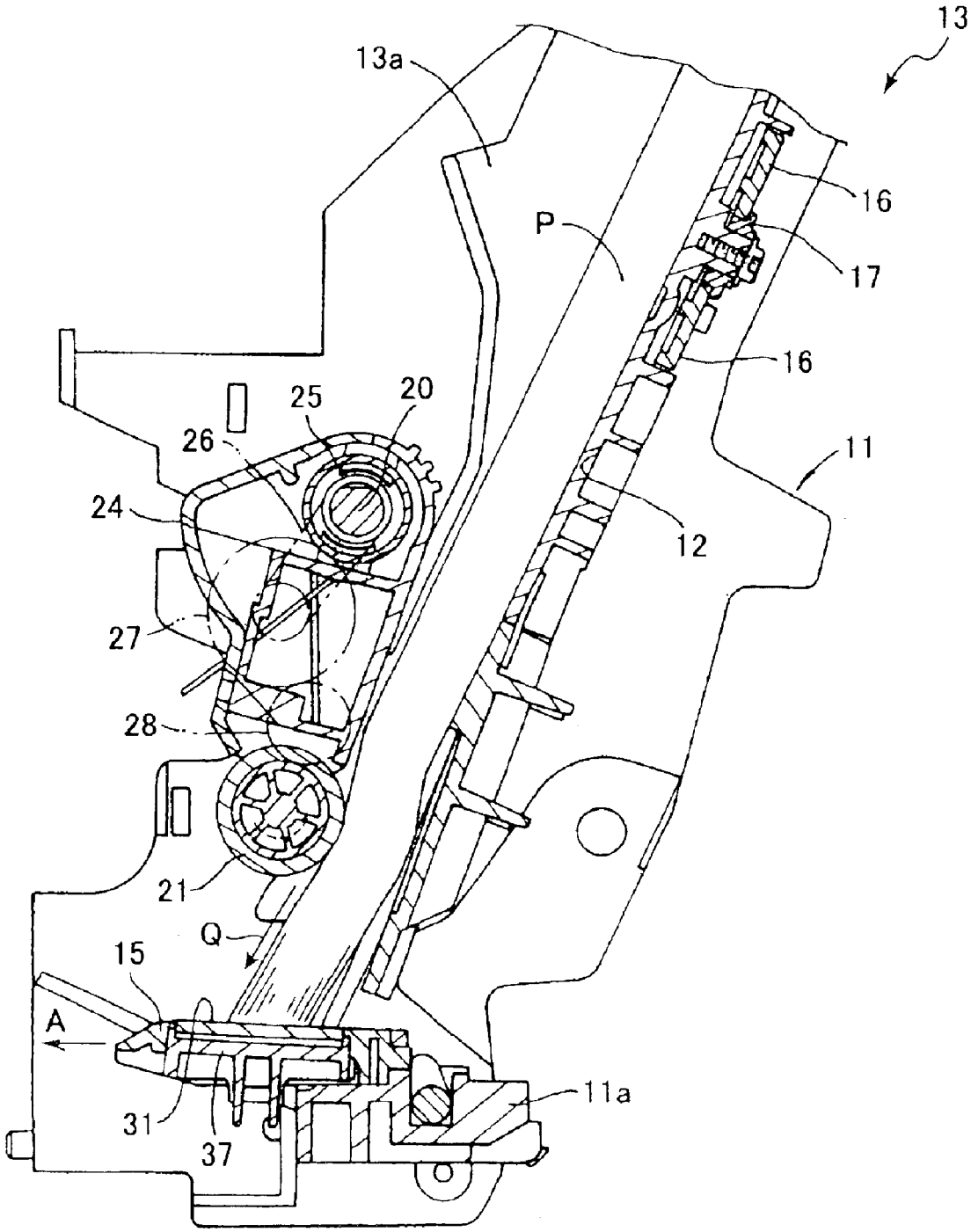
FIG. 4 is a cross-sectional view taken along line IV—IV of FIG. 3.

As shown in FIGS. 2 and 4, the sheet guide unit 13 includes guide plates 13*a*, 13*b*, racks 16, 16, and a pinion 17. The guide plates 13*a*, 13*b* are disposed at a position immediately above the slanting plate 12 and are movable in a horizontal direction at positions horizontally interior of the pair of side wall plates 14, 14. As shown in FIG. 4, the racks 16, 16 and the pinion 17 are positioned at the rear side of the slanting plate 12. The racks 16, 16 extend horizontally and are connected one to each of the guide plates 13*a*, 13*b* through slits 12*a* formed in the slanting plate 12. The pinion 17 is rotatably provided at a position in between and in meshing engagement with the racks 16, 16 so that the guide plates 13*a*, 13*a* are linked together.

With this configuration, when either of the guide plates 13*a*, 13*b* is shifted leftward or rightward across the slanting plate 12, the movement is transmitted to the remaining guide plate 13*a* or 13*b* through the pinion 17 and the racks 16, 16. As a result, the guide plates 13*a*, 13*b* are interlockingly moved toward each other and away from each other. This enables the user to easily set the stack of sheets P on the slanting plate 12 at a widthwise center of the slanting plate 12.

Figure 3:
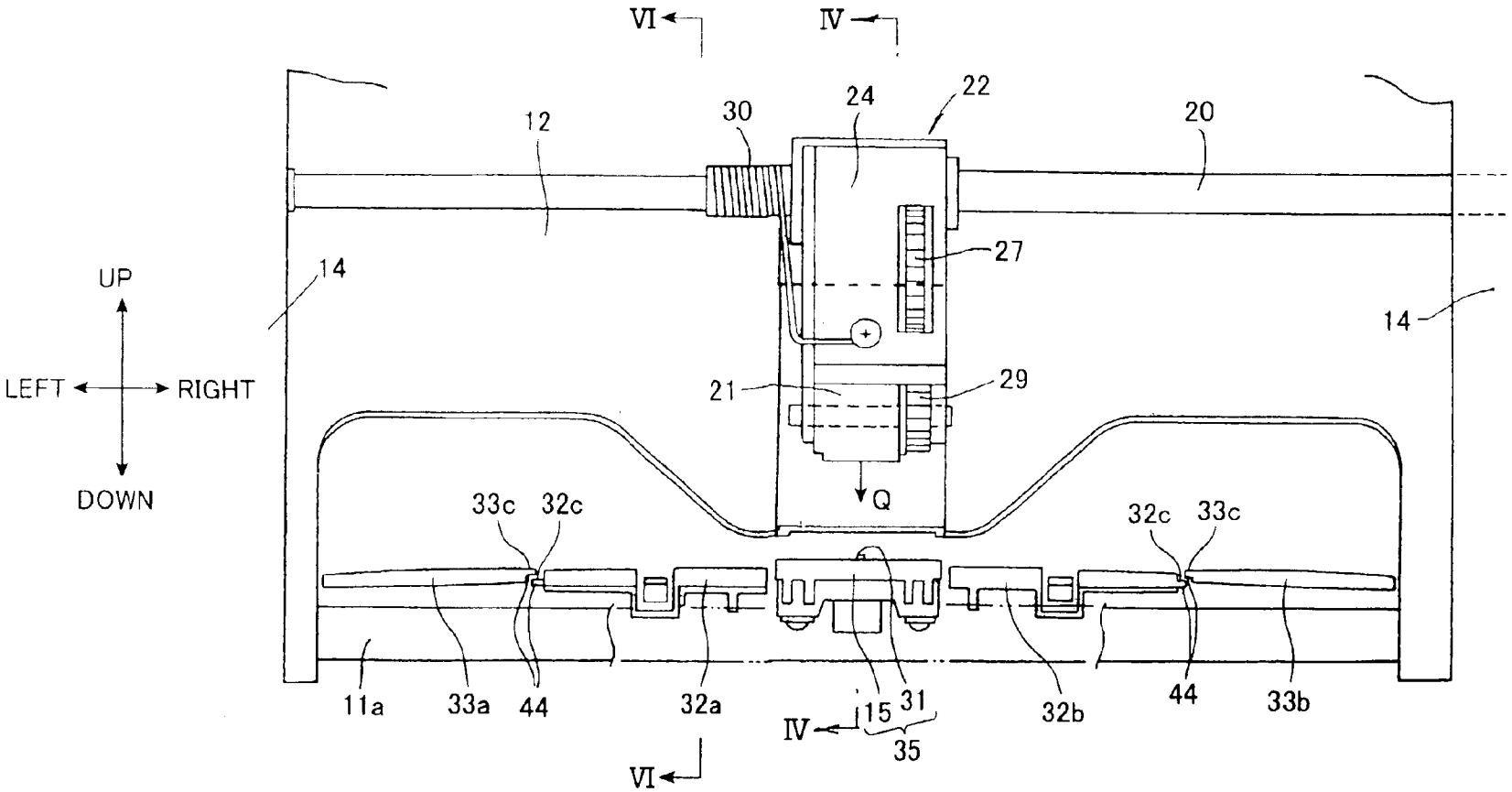
FIG. 3 is a frontal view showing essential portions of the sheet-supply device.

As shown in FIGS. 2, 3, and 4, the sheet supply roller unit 22 includes a transmission shaft 20, a case 24, a sheet-supply roller 21, a drive gear 25, a planetary gear 27, an intermediate gear 28, a roller gear 29, an arm 26, and a torsion spring 30. The transmission shaft 20 is freely rotatably supported between the left and right side wall plates 14, 14, separated from the front surface of the slanting plate 12 by an appropriate distance. The case 24 is mounted on the transmission shaft 20 at a fixed position in the substantially left-right direction center of the transmission shaft 20. The transmission shaft 20 is capable of rotating within the case 24, but the case 24 is fixed at a predetermined (central) widthwise position on the transmission shaft 20. The sheet-supply roller 21 is rotatably mounted at the lower end of the case 24. The torsion spring 30 is fitted on the transmission shaft 20 and resiliently urges the case 24 so that the sheet-supply roller 21 presses on the upper surface of the stacked sheets P.

An internal arrangement of the case 24 will be described with reference to FIG. 4. The drive gear 25 is fixedly mounted on the transmission shaft 20, so that the drive gear 25 is rotatable together with the rotation of the transmission shaft. The arm 26 is rotatably mounted on the transmission shaft 20. The planetary gear 27 is freely rotatably supported on the tip of an arm 26 and is meshingly engaged with the drive gear 25. The planetary gear 27 is selectively engageable with the intermediate gear 28 in accordance with the pivotal movement of the arm 26. The intermediate gear 28 is meshedly engaged with the roller gear 29 rotatable integrally with the sheet-supply roller 21.

The gear train 23 is disposed on the outer surface of one of the side wall plates 14, 14. The gear train 23 is for transmitting power from a drive motor (not shown) disposed on the side of the casing 2 to various components of the multi-function image forming device 1. The gear train includes gears 23*a*, 23*b*, 23*c*, and 23*d*. The gear 23*d* is fixed on the end of the transmission shaft 20.

Here operation of the sheet supply roller unit 22 will be described. In this explanation, the directions "clockwise" and "counterclockwise" will be used to refer to rotational directions as viewed in FIG. 4. When sheets are to be supplied, the drive motor (not shown) disposed on the side of the casing 2 is driven to rotate the gear 23*d* counterclockwise. Accordingly, the transmission shaft 20 and the drive gear 25 rotate counterclockwise as well. The planetary gear 27 rotates clockwise so that the arm 26 pivots counterclockwise about the transmission shaft 20, bringing the planetary gear 27 into meshing engagement with the intermediate gear 28. As a result, the intermediate gear 28 rotates counterclockwise and the gear 29 rotates clockwise. Therefore, the sheet-supply roller 21 rotates clockwise and feeds the uppermost sheet P in the stack downward as viewed in FIG. 4. The sheet-supply roller 21 generates a linear sheet-supply force Q indicated in FIG. 3.

On the other hand, when the gear 23*d* is rotated clockwise so that the transmission shaft 20 and the drive gear 25 rotate clockwise, the planetary gear 27 rotates counterclockwise so that the arm 26 pivots clockwise about the transmission shaft 20. This moves the planetary gear 27 out of meshing engagement from the intermediate gear 28 so that the sheet-supply roller 21 stops rotating and sheets are no longer fed out.

As shown in FIGS. 2 and 3, the sheet separation section 34 includes a fixed separation unit 35, first movable separation plates 32*a*, 32*b*, and second movable separation plates 33*a*, 33*b*. The fixed separation unit 35 includes a fixed separation plate 15 and a high-friction separation member 31. The separation plates 15, 32*a*, 32*b*, 33*a*, 33*b* are made from synthetic resin and are disposed on a lower frame portion 11*a* provided at the lower end of the slanting plate 12. The separation plates 15, 32*a*, 32*b*, 33*a*, and 33*b* extend from the lower frame portion 11*a* at an angle of about 3 degrees with respect to a horizontal plane so that each one's front edge extend upward. The separation plates 15, 32*a*, 32*b*, 33*a*, and 33*b* support the lower edges, i.e., leading edges of the stacked sheets on the slanting plate 12. Also, the separation plates 15, 32*a*, 32*b*, 33*a*, and 33*b* guide sheets P fed out by the sheet-supply roller unit 22 in a guide direction A shown in FIG. 4 to the image forming section.

As can be seen in FIG. 3, the fixed separation plate 15 is located at the widthwise center of the slanting plate 12 and at a position that is vertically below the sheet-supply roller 21 in the direction of the sheet-supply force Q. The first movable separation plates 32*a*, 32*b* are located on the left and right of the fixed separation plate 15. The second movable separation plates 33*a*, 33*b* are positioned to the outside of the first movable separation plates 32*a*, 32*b*, that is, on the opposite side of the first movable separation plates 32*a*, 32*b* than the side where the fixed separation plate 15 is positioned.

The upper surface of the sheet separation section 34 is formed by the upper surfaces of the plates 15, 32*a*, 32*b*, 33*a*, 33*b*. As can be seen in the view of FIG. 3, upper surfaces of the plates 15, 32*a*, 32*b*, 33*a*, 33*b* are shaped so that overall their upper surfaces form a slightly upwardly protruding convex shape with a radius of curvature of about 1,500 mm, wherein the left-right direction center is vertically closest to the sheet-supply roller 21 and the outer left and right edges are vertically farthest from the sheet-supply roller 21. That is, the upper surfaces of the plates 15, 32*a*, 32*b*, 33*a*, 33*b* are located farther from the sheet-supply roller 21 with respect to the sheet feed direction with increasing proximity to the outer edges of the second movable separation plates 33*a*, 33*b*. According to the present embodiment, the center of the upper surface of the sheet separation section 34 is about 2.0 mm to 3.0 mm higher than the outer edges, assuming that the outer edges of the pair of second movable separation plates 33*a*, 33*b* are separated by a distance of about 210 mm. Also, the upper surface of the sheet separation section 34 extends from the lower frame portion 11*a* at an obtuse angle of about 112.5 degrees with respect to the slanting plate 12.

Figure 5:
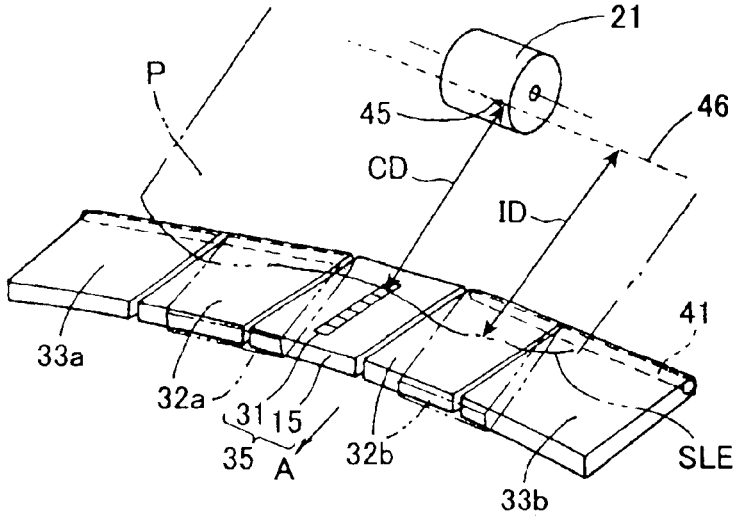
FIG. 5 is a perspective view showing a sheet separation section of the sheet-supply device according to the first embodiment, the sheet separation section including fixed members and movable members.
Figure 6:
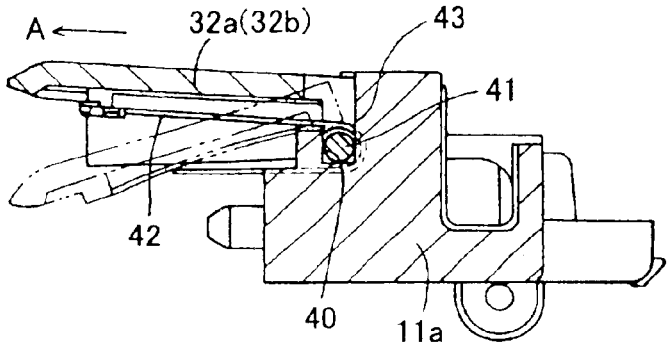
FIG. 6 is a cross-sectional view taken along line VI—VI of FIG. 3.

As shown in FIGS. 5 and 6, the base edges of the movable separation plates 32*a*, 32*b* and 33*a*, 33*b* are each formed into a pivot shaft 41 that extends horizontally. The pivot shafts 41 are rotatably disposed in a bearing groove 40 formed in the lower frame portion 11*a*. A separate torsion spring 42 is fitted on each of the pivot shafts 41 with ends engaged at appropriate locations for generating a spring urging force that urges the movable separation plates 32*a* to 33*b* independently upward. Each movable separation plate 32*a* to 33*b* is pivotally moved downward upon application of pressure against the biasing force of the torsion springs 42 when the leading edge of the sheet presses the movable separation plate 32 during supply of the sheet to the image forming section. Because the movable separation plates 32*a* to 33*b* are independently pivotable, only the selected one of the movable separation plates that are in pressure contact with the leading edge of the sheet are pivotally moved downwardly, while the remaining movable separation plates out of contact from the leading edge maintain their upward orientation by the biasing force of the torsion springs 42. This can provide an optimum resistive force of the movable separation plates in accordance with the width of the sheet.

As shown in FIG. 6, the movable separation plates 32*a* to 33*b* are disposed in the bearing groove 40 so that a vertically extending base surface 43 of each movable separation plate abuts against the vertical inner surface of the bearing groove 40 when the movable separation plates 32*a* to 33*b* are pivoted upward about the shafts 41. As a result, each of the first movable separation plates 32*a*, 32*b* is restricted so that its upper surface does not protrude upward above the upper surface of the adjacent fixed separation plate 15. Also, each of the second movable separation plates 33*a*, 33*b* is restricted so that its upper surface does not protrude upward above the upper surface of the adjacent first movable separation plate 32*a* (32*b*). It should be noted that another type of stopper arrangement can be provided instead of the abutment between the wall of movable separation plates and the wall of the recess 40 to prevent the movable separation plates from pivoting upward more than necessary.

As shown in FIG. 3, each of the first movable separation plates 32*a*, 32*b* is formed with an engagement rib 32 *c* that protrudes horizontally toward the adjacent one of the second movable separation plates 33*a*, 33*b*. Similarly, each of the second movable separation plates 33*a*, 33*b* is formed with an engagement rib 33*c* that protrudes horizontally toward the adjacent one of the first movable separation plates 32*a*, 32*b*. However, the engagement ribs 32*c* of the first movable separation plates 32*a*, 32*b* extend below the engagement ribs 33*c* of the second movable separation plates 33*a*, 33*b*. With this configuration, when a downward load is applied to the second movable separation plate 33*a* (33*b*) so that the second movable separation plate 33*a* (33*b*) pivots downward, the engagement rib 33*c* of the second movable separation plate 33*a* (33*b*) presses the engagement rib 32*c* of the first movable separation plates 32*a* (32*b*) downward. Consequently, the first movable separation plate 32*a* (32*b*) pivots downward.

Figure 8A:
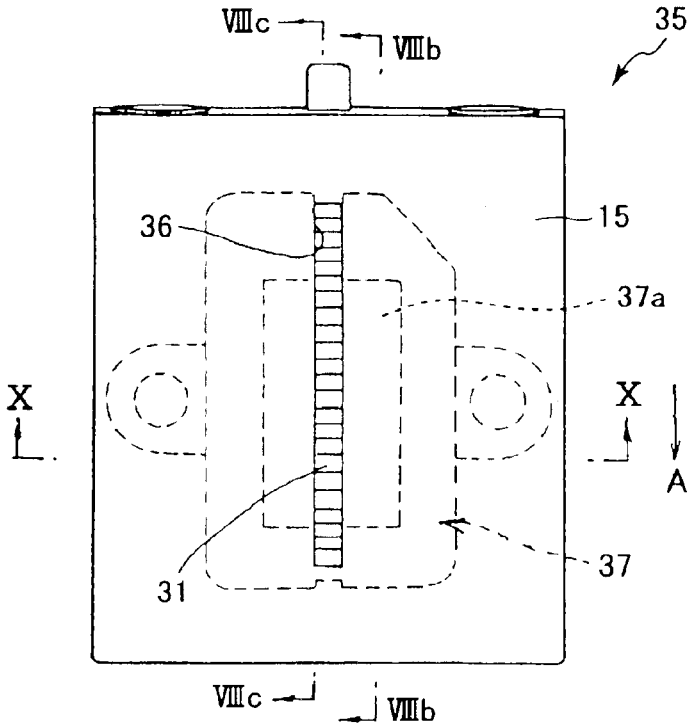
FIG. 8(*a*) is a plan view showing a fixed separation unit of the sheet-supply section of FIG. 5.
Figure 8B:
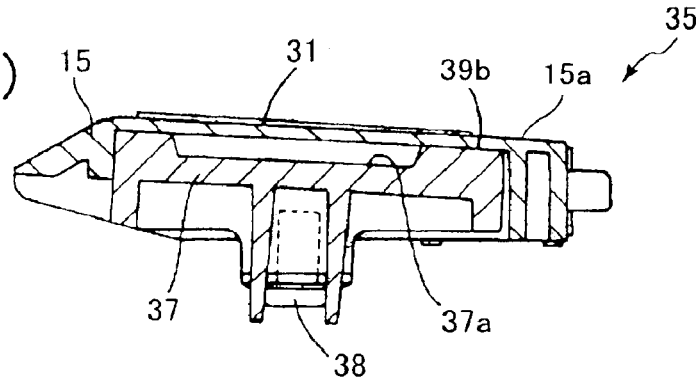
Figure 8C:
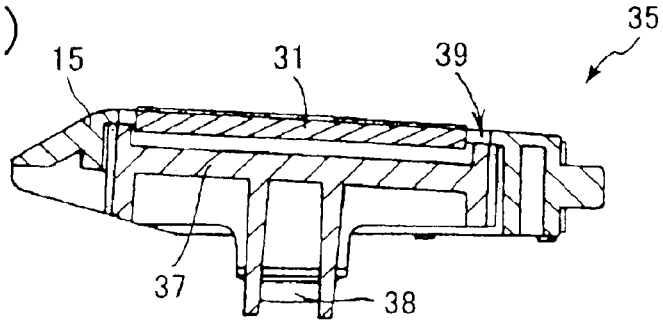
Figure 9A:
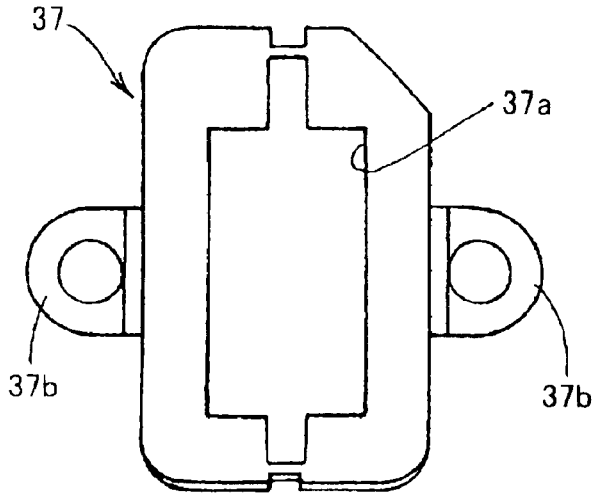
FIG. 9(*a*) is a plan view showing a base block of the fixed separation unit.
Figure 9B:
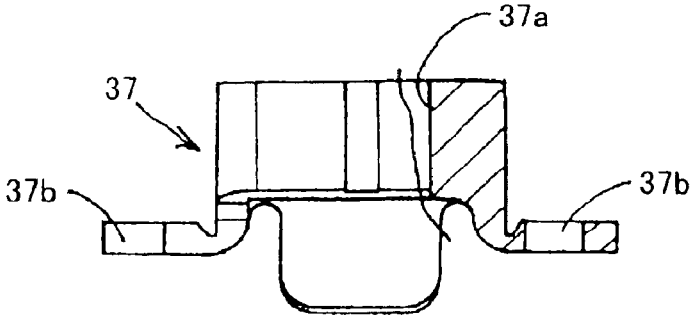
Figure 9C:
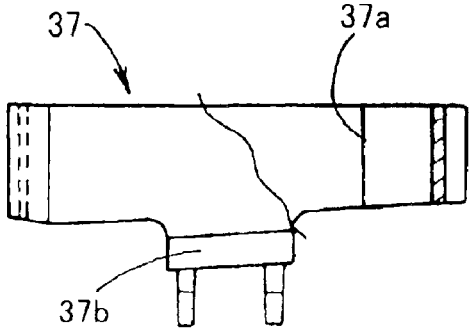
Figure 10:
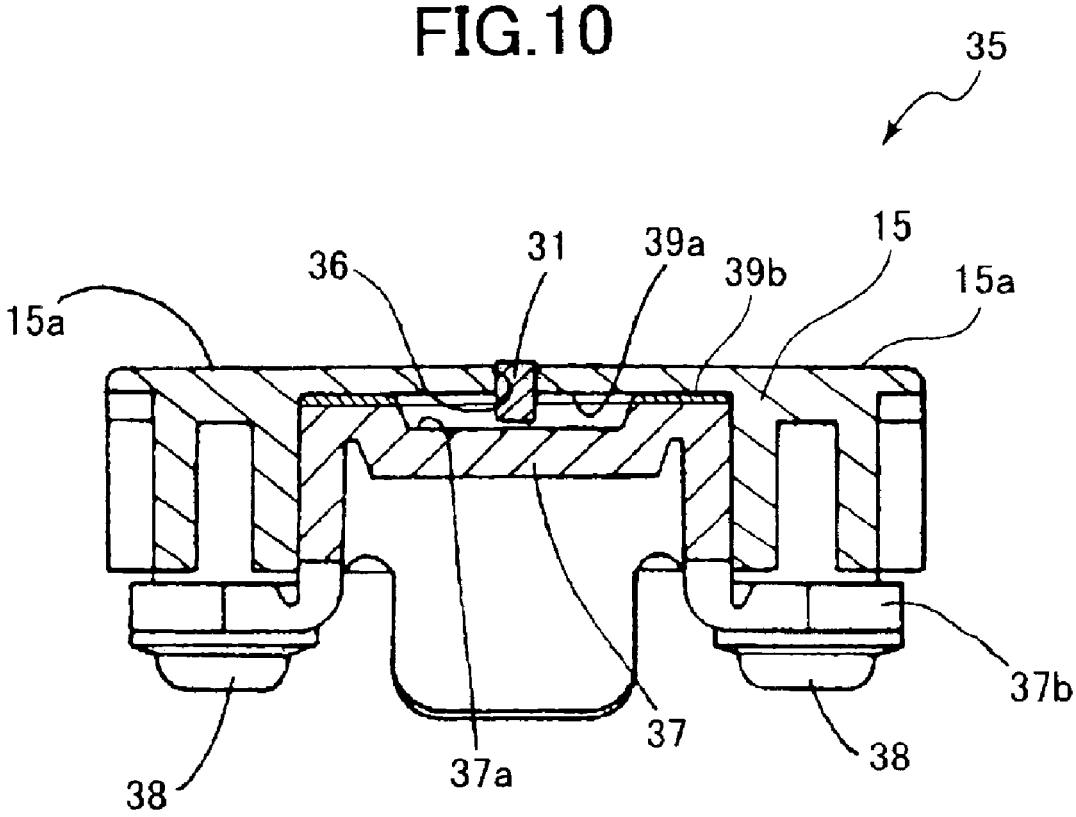
FIG. 10 is a cross-sectional view taken along X—X of FIG. 8(*a*)

As shown in FIGS. 8(*a*) to 11(*c*), the fixed separation unit 35 includes the fixed separation plate 15 and the high-friction separation member 31 as described above, and further includes a resilient support plate 39 and a base block 37. The fixed separation plate 15 is formed with a slot 36 opened vertically through the left-right center of the upper surface of the fixed separation plate 15. The slot 36 is elongated following the guide direction A in which sheets are guided by the plates 15, 32*a*, 32*b*, 33*a*, 33*b* of the sheet separation section 34. The high-friction separation member 31 is inserted from the underside surface of the fixed separation plate 15 and disposed in the slot 36. The high-friction separation member 31 is made from a material having a high coefficient of friction, such as polyester urethane resin. The resilient support plate 39 is sandwiched by and supported between the fixed separation plate 15 and the upper surface of the base block 37.

Figure 11A:
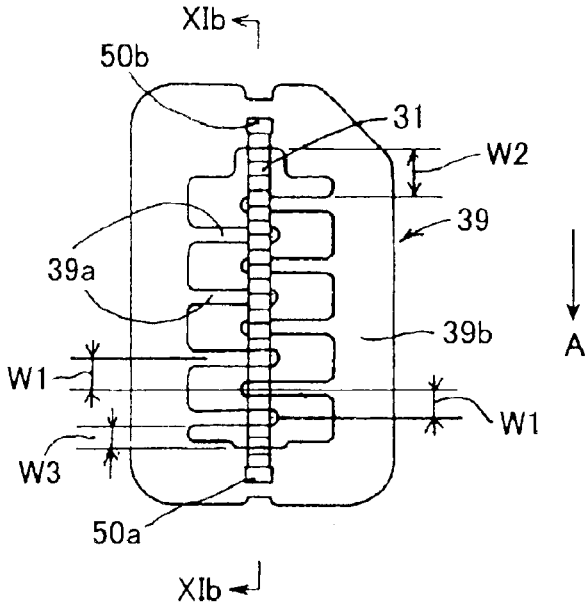
FIG. 11(*a*) is a plan view showing a resilient support plate of the fixed separation unit.
Figure 11B:
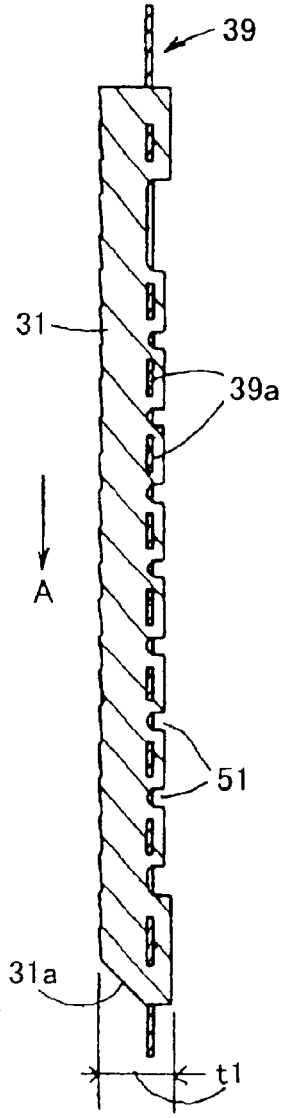
Figure 11C:
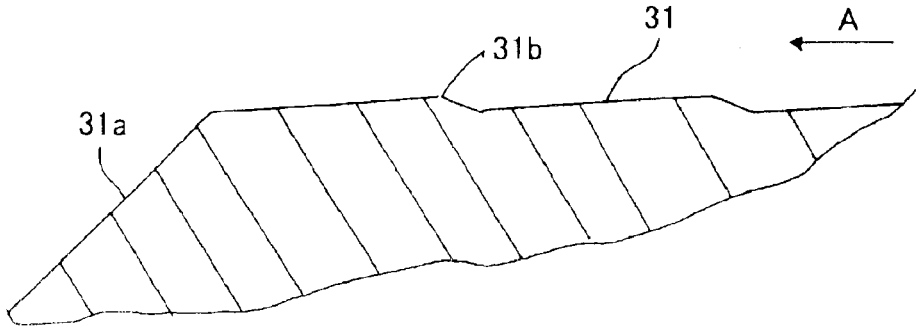

As shown in FIG. 11(*a*), the resilient support plate 39 is made integrally from metal and is substantially rectangular shaped when viewed in plan. The resilient support plate 39 resiliently supports the high-friction separation member 31 in the slot 36 so that the high-friction separation member 31 protrudes above the upper surface of the fixed separation plate 15 by a height of about 0.1 mm to 0.35 mm. The thickness of the resilient support plate 39 itself is about 0.10 mm to 0.12 mm.

The resilient support plate 39 includes an outer peripheral frame 39*b* and a plurality of resilient cantilevers 39*a*. The outer peripheral frame 39*b* has a substantially rectangular shape when viewed in plan, wherein the longer sides extend in the guide direction A. As viewed in plan, the resilient cantilevers 39*a* extend from the inner edges of the longer sides of the outer peripheral frame 39*b* in a direction perpendicular to the guide direction A. The left and right side resilient cantilevers 39*a* are separated by an appropriate distance W1 and have a staggered formation so that the free ends of the righthand and lefthand sets of cantilevers 39*a* extend in between each other. The resilient support plate 39 can be formed stamp machining, electric discharge machining, or laser machining so that the resilient cantilevers 39*a* are integral with the inside of the outer peripheral frame 39*b* in this manner.

The resilient support plate 39 is formed so that a distance W2 is larger than a distance W3. The distance W2 is the distance between the upstream inner edge of the outer peripheral frame 39*b* and the directly adjacent resilient cantilever 39*a*. The distance W3 is the distance between the downstream inner edge of the outer peripheral frame 39*b* and the directly adjacent resilient cantilever 39*a*. Accordingly, the distance W3 at the downstream side in the guide direction A is narrower. Said differently, greater numbers of cantilevers 39*a* support the high friction member 31 per unit distance in the guide direction at the downstream side of the high friction member 31 than at the upstream side of the high friction member 31. Therefore, a greater load is needed to deform the downstream side than the upstream side.

An engagement hole 50*a* is formed through the downstream side of the outer peripheral frame 39*b* and the engagement hole 50*b* is formed through the upstream side of the outer peripheral frame 39*b*. The front and rear ends of the high-friction separation member 31 are fittingly engaged in the engagement holes 50*a*, 50*b*. The free end of each resilient cantilever 39*a* penetrates laterally through the high-friction separation member 31. The high friction separation member 31 has a thickness t1, and each penetrating position is deviated toward the lower surface of the high-friction separation member 31 in thickness direction, the lower surface being opposite to the upper surface along which the sheet passes as best shown in FIG. 11(*b*).

As shown in FIG. 8(*b*), the high-friction separation member 31 and the resilient cantilevers 39*a* are disposed in an inside indentation 37*a* of the synthetic resin base block 37. In this condition, only the base plate 39*b* of the resilient support plate 39 is sandwiched between the upper surface of the base block 37 and the lower surface of the fixed separation plate 15. With this arrangement, the high-friction separation member 31 and the resilient cantilevers 39*a* hang over a hollow space. This increases the degree that the resilient cantilevers 39*a* and the high-friction separation member 31 can respond the pressing force from the sheet stack.

It should be noted that attachment portions 37*b* are positioned at both the left and right sides of the base block 37. Screws 38, 38 are screwed through attachment portions 37*b* from the underside surface of the base block 37. With this arrangement, the fixed separation plate 15 is detachably connected to the base block 37 by the screws 38, 38.

The high-friction separation member 31 has a high friction coefficient and is thus disposed in the fixed separation plate 15. The high-friction separation member 31 is positioned at a horizontally central position of the fixed separation plate 15 and at a position along an imaginary extension line of the sheet-supply force Q. The high-friction separation member 31 protrudes above the upper surface of the fixed separation plate 15. As a result, the widthwise center of the leading lower edge of the sheets P abut against the high-friction separation member 31 when fed out by the sheet-supply roller 21 and are separated from the stack. Because the high-friction separation member 31 is at the center of the fixed separation plate 15 and the upper surfaces of the plates 15, 32*a*, 32*b*, 33*a*, 33*b* are slightly convex shaped overall, the widthwise edges of the lower edge of the sheets P do not collide with the upper surfaces of the plates 15, 32*a*, 32*b*, 33*a*, 33*b*. Therefore the widthwise center of the lower edge of the sheets P properly abuts against the high-friction separation member 31 and receives sufficient separation force. As a result, improper sheet supply of two sheets being fed at the same time can be prevented from occurring.

As shown in FIG. 11(*b*), the upper surface of the high-friction separation member 31, i.e., the left side face in FIG. 11(*b*) is formed in a shallow saw-toothed shape to apply a large friction resistance against the lower edge of the sheets P as the sheets P slide against the high-friction separation member 31. With this configuration, the shape, not just the material, of the high-friction separation member 31 increases the coefficient of friction of the high-friction separation member 31.

As shown in FIG. 11(*c*), each tooth of the saw-toothed shape at the upper surface of the high-friction separation member 31 has an upstream side, a downstream side, and an apex 31*b* between the upstream side and the downstream side. The apexes 31*b* are shifted upstream in the guide direction A so that the upstream sides have a steeper rising edge angle than the downstream sides. With this configuration, the steeply slanting surface of the saw-toothed shape is positioned at the upstream side. Therefore, sheets P can be effectively held on the slanting plate 12, so that sheets P will not slide down from the slanting plate 12. At the same time, the sheets P smoothly pass over the downstream side until abutting against the next steeply-slanted upstream side. Therefore, the sheets P can move easily and are effectively separated.

As shown in FIG. 11(*c*) the high-friction separation member 31 is formed with its downstream edge 31*a* notched at a slant. The slanting downstream edge 31*a* slants gradually away from the sheet or an imaginary extension line of the saw-toothed surface of the high-friction separation member 31 toward the guide direction A. It is undesirable for the fed out sheet P to remain in contact with the high-friction separation member 31 for excessively long a time, because this would impede the movement of the sheet P. On the other hand, if the high-friction separation member 31 is made shorter by cutting at the downstream end portion vertically with respect to the upper surface thereof rather than the slanted edge, then the downstream end portion of the high-friction separation member 31 would deform too easily, which would diminish the ability of the high-friction separation member 31 to separate sheets. In the illustrated embodiment, because the high-friction separation member 31 is cut at a slant, more material is retained at the downstream edge 31*a* of the high-friction separation member 31 so the downstream edge 31*a* is better prevented from deforming. The high-friction separation member 31 can provide sheet separation ability along its entire length. The angle of the notch can be about 45 degrees. Actually, most any angle is acceptable as long as the high-friction separation member 31 does not deform, so the angle of the notch can be selected from within the range of 30 degrees to 60 degrees as appropriate for the material of the high-friction separation member 31.

A method of manufacturing the high-friction separation member 31 with the resilient support plate 39 mounted therein will be described. Upper and lower metal molds (not shown) are formed with a cavity therebetween that corresponds to the high-friction separation member 31. The resilient support plate 39 is then interposed between the upper and lower molds. In this condition, a predetermined resin is injected into the cavity. As a result, high-friction separation member 31 can be formed with the tips (free ends) of the resilient cantilevers 39*a* penetrating laterally through the thickness portion of the high-friction separation member 31, thereby resiliently supporting the high-friction separation member 31.

Next, sheet supply operations performed by the sheet-supply device 10 will be described. First, the user stacks sheets P onto the slanting plate 12 so that the lower edge of all sheets P in the stack abuts against the high-friction separation member 31 and/or the upper surface of the fixed separation plate 15. Then, the user shifts the left and/or right guide plates 13*a*, 13*a* against the left and right edges of the stack of sheets P so that the widthwise direction center of the sheets P will be positioned at the left-right central position of the slanting plate 12.

Figure 12A:
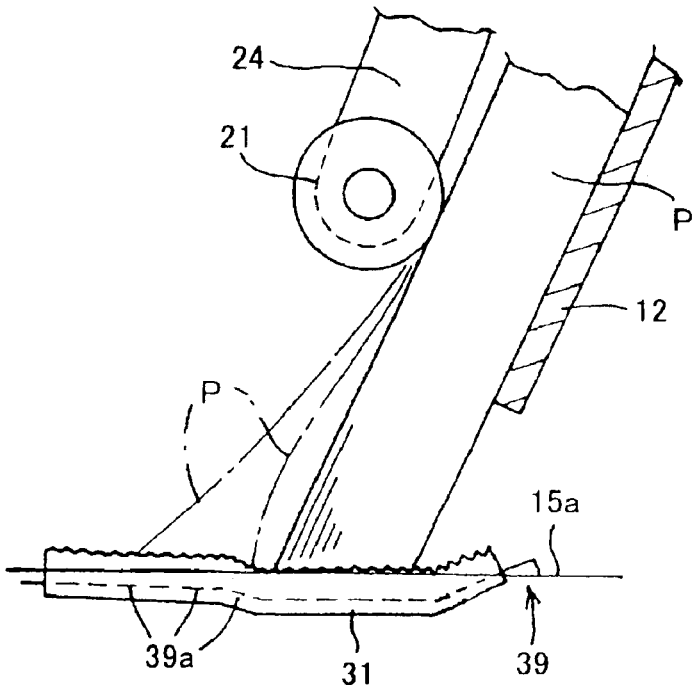
FIG. 12(*a*) is a side view showing sheet separation operations of the sheet-supply device of FIG. 2 when sheets have a low stiffness.
Figure 12B:
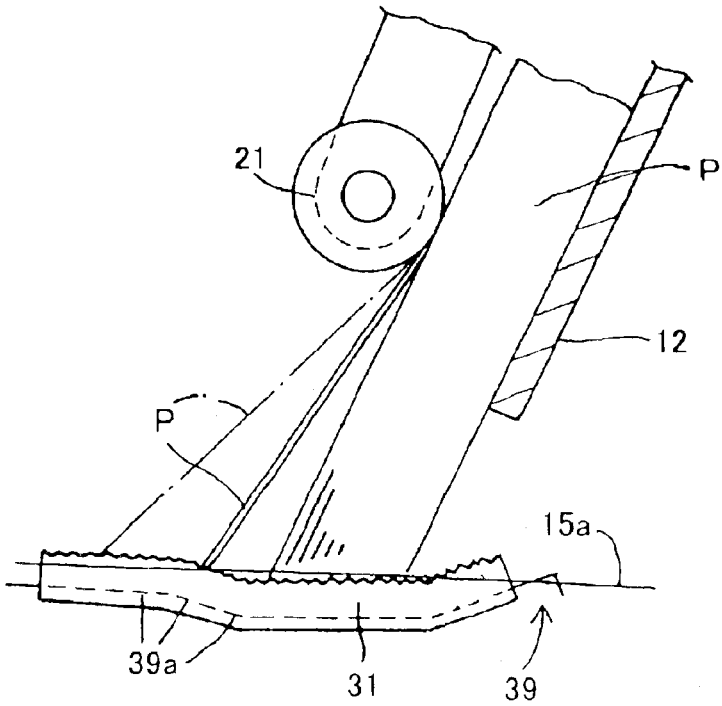

At this time, the sheets P apply a load on only a portion of the high-friction separation member 31 as shown in FIGS. 12(*a*) and 12(*b*). Only the resilient cantilevers 39*a* located under the load bend downward. That portion of the high-friction separation member 31 will bend downward under the weight of the stacked sheets accordingly so that its upper surface sinks down to same plane as the upper surface of the fixed separation plate 15. Contrarily, the weight of the stacked sheets P will not influence the portion of the high-friction separation member 31 that is located downstream in the guide direction A from the stack of sheets P. Therefore, the downstream portion of the high-friction separation member 31 will remain protruding upward above the upper surface of the fixed separation plate 15 and prevent the sheets P from sliding in the guide direction A, even if the sheets P have low stiffness. This is of course true for stiff sheets P as well. The sheets P will be maintained in a stacked condition in parallel with the slanting plate 12.

As shown in FIGS. 12(*a*) and 12(*b*), a pressure contact area of the leading edges of the sheets P with the high-friction separation member 31 is deviated toward the upstream side thereof. Therefore, even if the pressure contact portion of the high-friction separation member 31 is bent to a greater extent than the sheet supply downstream area of the high-friction separation member 31, the remaining portion out of pressure contact with the leading edges of the sheets can still protrude above the upper surface of the fixed separation plate 15.

In this instance, it should be noted that the lower edges of the stacked sheets P do not abut against the upper surface of the first movable separation plate 32*a* (32*b*) and the second movable separation plates 33*a* (33*b*), because these are lower than the upper surface of the fixed separation plate 15.

When a print command is received from an external control device, such as a personal computer or an external facsimile machine, then the drive motor (not shown) is driven to rotate the transmission shaft 20 counterclockwise as viewed in FIG. 4 through the gear train 23*a* to 23*d*. As a result, the sheet-supply roller 21 rotates in the clockwise direction in FIG. 4.

When the sheet-supply roller 21 feeds a sheet P downward, the lower leading edge of the sheet P pushingly abuts against the upper surfaces of the moveable separation plates 32*a*, 32*b* or 33*a*, 33*b*, depending on the width of the sheet P. The sheet P presses the corresponding moveable separation plates 32*a* to 33*b* downward so that the free end of each corresponding movable separation plates 32*a* to 33*b* pivots downward against the upward spring urging force of the torsion spring 42. As a result, the movable separation plates 32*a* to 33*b* move out of the way under the pressing force of the sheet P. Because a torsion spring 42 is provided separately for each of the movable separation plates 32*a* to 33*b*, the upward spring urging force can be set to enable only the movable separation plates 32*a* to 33*b* that are located at locations appropriate for the horizontal width of the sheets P to pivot downward and retract. The resistance by the spring urging force will never be excessive or insufficient.

Figure 18:
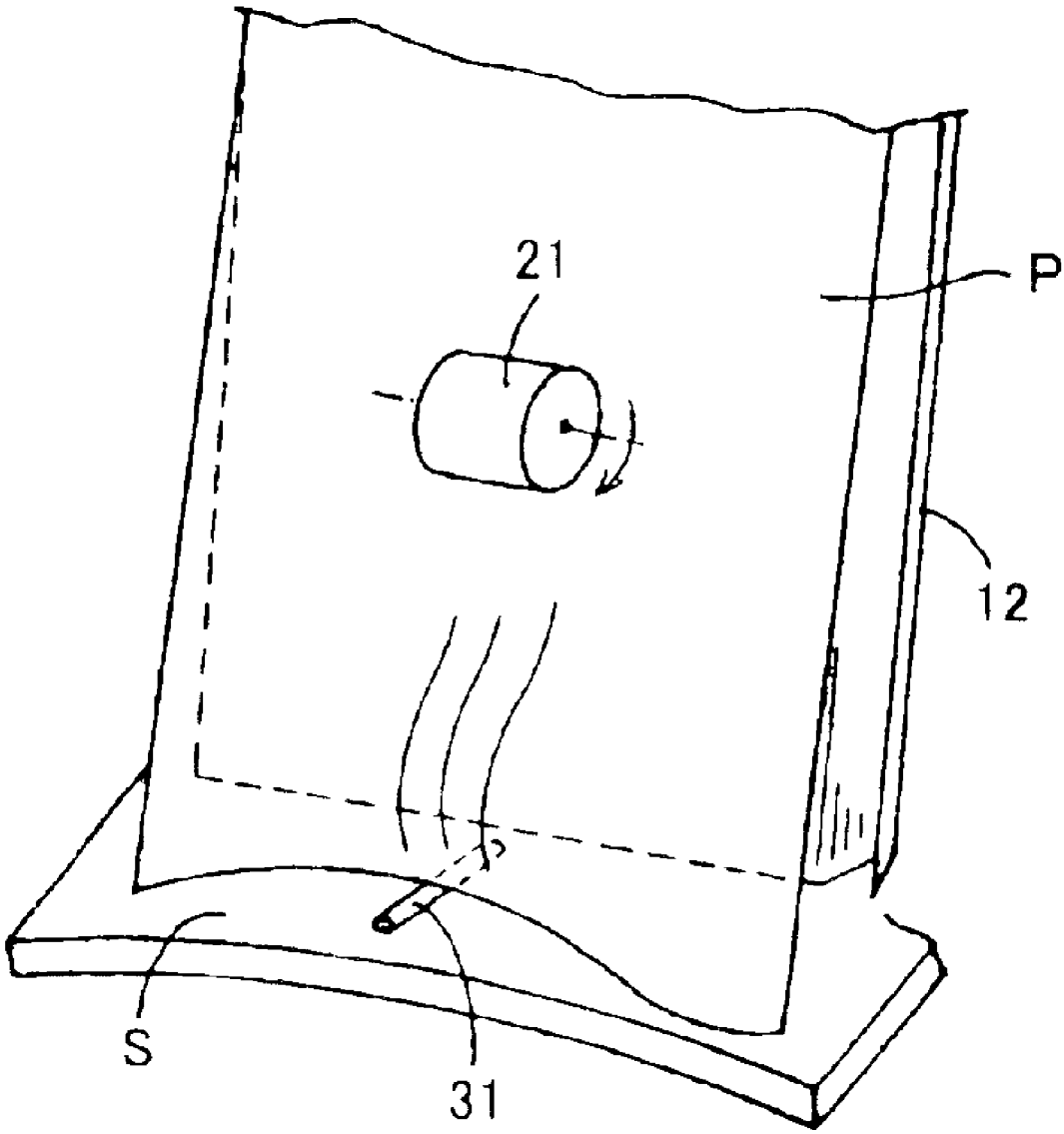
FIG. 18 is a schematic perspective view for description of curvature of a sheet having low stiffness according to the present invention.

Accordingly, the uppermost sheet P in the stack receives sheet supply force from the sheet-supply roller 21 so that the lower edge of the uppermost sheet P presses downward on the high-friction separation member 31. When the sheet P has low stiffness, then at this time only a weak force will press down on the high-friction separation member 31. The high-friction separation member 31 will hardly move down at all. The widthwise central portion of the sheet P will be protrudingly deformed upwardly between the sheet-supply roller 21 and the high-friction separation member 31 as shown in FIG. 18. Incidentally, FIG. 18 collectively shows the fixed separation plate 15 and the movable separation plates 32*a* to 33*b* as a single separation plate S for describing the action of the sheet P having the low stiffness. Thus, the uppermost sheet can be separated from the next sheet at least at the protruding area. This facilitate the sheet separation. In this deformation, the widthwise edges of the leading end of the sheet is brought into contact with the widthwise end portions of the separation plates at a timing earlier than the contact of the widthwise center of the leading end of the sheet. However, because the sheet has a low stiffness, and because height of the widthwise end portion of the separation plate S is lower than that of the widthwise center thereof as also shown in FIG. 3, the sheet running is not restricted by the abutment of the widthwise edges of the sheet onto the separation plate S, but the widthwise edges of the sheet can be slidingly moved along the lower level areas of the separation plate S.

On the other hand, when the sheet P has a high stiffness, for example because it is made from thick paper, the uppermost sheet P in the stack retains its substantial flat shape even while pressed downward by the sheet-supply roller 21. In this case, the lower edge of the sheet P presses strongly downward on the upper surface of the high-friction separation member 31. Therefore, the resilient cantilevers 39*a* near where the force operates bend downward. The upper surface of the high-friction separation member 31 retracts downward until at the same height as the upper surface 15*a* of the fixed separation plate 15. At this point, the lower edge of the uppermost sheet P is released from the high friction surface of the high-friction separation member 31 so that only the uppermost sheet P is separated from the stack by the force of the sheet-supply roller 21 and is fed in guide direction A of FIG. 5.

Incidentally, the pivotal retraction of the movable plates 32*a* to 33*b* is advantageous for allowing the leading widthwise edges of the sheet having high stiffness to be smoothly moved past these movable plates 32*a* to 33*b*, otherwise, the leading widthwise edges of the sheet are subjected to resistance against these plates due to high stiffness of the sheet.

It should be noted that as shown in FIG. 11(*b*) notches 51 are formed in the lower surface side of the high-friction separation member 31 at positions between the resilient cantilevers 39*a*. The notches 51 are for locally reducing the thickness of the high-friction separation member 31. The notches 51 increase the amount that the high-friction separation member 31 deforms between adjacent resilient cantilevers 39*a*, 39*a* when resiliently bent by pressure applied from the high friction surface (upper surface) of the high-friction separation member 31. Consequently, deforming response or degree of the high-friction separation member 31 can be controlled by the numbers and/or depth of the notches 51 regardless of the material of the high-friction separation member 31 itself.

The support force (supporting resistance force) of the high-friction separation member 31 and accordingly the amount that the high-friction separation member 31 sinks down under pressing force, can be adjusted by changing the thickness or material of the resilient support plate 39, or changing the length or modulus of section of the resilient cantilevers 39*a*. Also, if the resilient support plate 39 is made from a metal such as phosphor bronze or stainless steel, the spring coefficient is stable without large fluctuations occurring from change in temperature or humidity in the environment where the sheet-supply device is normally located. Therefore, the above-described sheet separation operation and effects are also stable.

Because the widthwise direction center of the sheets P is positioned at the left-right central position of the slanting plate 12 as is the sheet-supply roller 21 itself, the sheet-supply force Q is exerted on the substantial center of the sheets P. The center of the sheet P presently being fed out rises slightly up from the slanting plate 12 under this force as shown by FIG. 18. Contrarily, portions of the sheet P that do not receive sheet-supply force, that is, portions nearer the widthwise edges of the sheets P, move forward while substantially flat against the slanting plate 12. As a result, the lower edge of the sheet P that is presently being fed out protrudes lower at portions nearer the widthwise edges than at the center. That is, as shown in FIG. 5, the center distance CD is shorter than the intermediate distance ID. The center distance CD is the linear distance from a nip line 45 to the lower edge of the sheet P. The nip line 45 is the position where the sheet-supply roller 21 abuts against the sheet P. The intermediate distance ID is the linear distance from somewhere along an extension line 46 to the lower edge of the sheet P. The extension line 46 is a line extending from the nip line 45 to the widthwise edge of the sheet P. When the sheet P being fed out is a relatively pliable type, the left and right portions of the lower edge of the sheet P can be properly stopped by the first movable separation plate 32*a* (32*b*) and/or the second movable separation plate 33*a* (33*b*) without changing the height of the fixed separation plate 15. In other words, if the separation plate S in FIG. 18 has a small radius of curvature, the leading edge of the pliable sheet is abutted only on the central high-friction separation member 31. This may cause deformation of the sheets at the high-friction separation member 31, and a plurality of sheets may be dammed at the high-friction separation member 31, and finally the plurality of sheets will be rushed in the downstream direction. In order to avoid this problem, the separation member S (FIG. 18) has an optimum radius of curvature to provide a moderate curvature, so that the leading edge of the sheet can also be brought into contact with the lateral sides of the separation member S, i.e., the movable separation plates 32*a* to 33*b*.

On the other hand, when the sheet P is a stiff type, the lower edge of the sheet P presses downward with a higher pressing force. At this time, the first movable separation plate 32*a* (32*b*) and the second movable separation plate 33*a* (33*b*) pivot downward against the urging force of the torsion spring 42. By this, the upper surface of the first movable separation plate 32*a* (32*b*) and the second movable separation plate 33*a* (33*b*) retract away from the lower edge of the sheet P so that they do not interfere with downward supply movement of the sheet P. Therefore, the widthwise center of the lower edge of the sheet P will properly abut against the high-friction separation member 31 so that the sheet P will be properly separated from the stack. Paper jams caused by two sheets P being fed out at the same time can be reliably prevented.

The movable separation plates 32*a* to 33*b* operate differently depending on whether sheets P stacked on the slanting plate 12 are large or small sized. In the present embodiment, the "size" of sheets P refers to the widthwise dimension of the sheets P in the horizontal direction. More particularly, sheets P are considered "small sized" when their left and right edges are located in between outer edges of the first movable separation plates 32*a*, 32*b*. On the other hand, sheets P are considered "large sized" when they are wider, between their left and right edges, than the distance between the inner sides of the left and right hand second movable separation plates 33*a*, 33*b*. When small sized sheets P are stacked on the slanting plate 12, the portions of the lower edge nearer the widthwise edges of the sheets P press the first movable separation plates 32*a*, 32*b* downward so that the first movable separation plates 32*a*, 32*b* retract by pivoting. However, the second movable separation plates 33*a*, 33*b* do not get in the way of the sheets P and so do not pivot downward at this time.

When large sized sheets P are stacked on the slanting plate 12, portions of the lower edge of the sheets P that are near the widthwise edges of the sheets P abut against the upper surface of the second movable separation plates 33*a*, 33*b* so that the second movable separation plates 33*a*, 33*b* pivot downward. At this time, the first movable separation plates 32*a*, 32*b* also pivot downward by the linking operation of the engagement ribs 32*c*, 33*c*. Therefore, the first movable separation plates 32*a*, 32*b* can be pivoted downward and interference between the lower widthwise edge of the sheet P with the first and second movable separation plates can be even more reliably reduced, even if the portion of lower edge located between the widthwise center portion of the sheet P and the position near the widthwise edges does not abut the upper surface of the first movable separation plates 32*a*, 32*b*.

Figure 7:
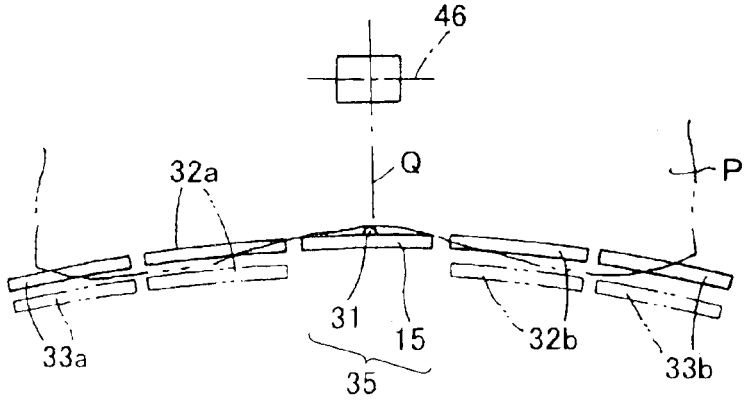
FIG. 7 is schematic plan view showing a sheet-supply device according to a modification to the first embodiment.

FIG. 7 shows a modification of the first embodiment. In this modification, an upward urging means (not shown) such as coil springs are provided to the lower surface side of the first movable separation plate 32*a* (32*b*) and the second movable separation plate 33*a* (33*b*). Moreover, all of the movable separation plates are supported to move vertically in parallel as shown by a solid line and a two dotted chain line in FIG. 7. The same operation effects can be achieved as in the first embodiment.

Figure 13:
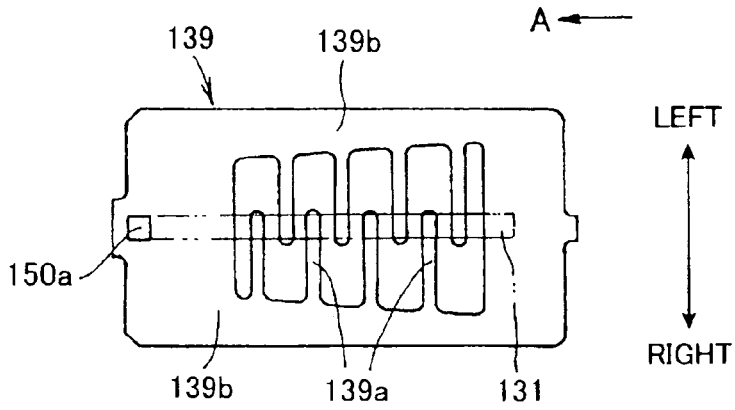
FIG. 13 is a plan view showing a resilient support plate according to a second embodiment of the present invention.

Next, a resilient support plate 139 according to a second embodiment of the present invention will be described with reference to FIG. 13. The resilient support plate 139 includes an outer peripheral frame 139*b* and resilient cantilevers 139*a* similar to those of the first embodiment. Similarly, the resilient cantilevers 139*a* protrude from the outer peripheral frame 139*b*. However, the resilient cantilevers 139*a* at the upstream end of the outer peripheral frame 139*b* with respect to the guide direction A are formed longer than those at the downstream end. Said differently, the resilient cantilevers 139*a* nearer the slanting plate 12 are longer. The cantilevers 139*a* are gradually shorter with distance downstream with respect to the guide direction A. The outer peripheral frame 139*b* is formed with an engagement hole 150*a*. A high-friction separation member 131 is mounted in the engagement hole 150*a* and supported on the free ends of the cantilevers 139*a*. The cantilevers 139*a* that are located farther upstream in the guide direction A support the high friction member 131 at positions separated farther from the outer peripheral frame 139*b* than positions where cantilevers 139*a* that are located downstream in the guide direction A support the high friction member 139*a*.

With this configuration, the cantilevers 139*a* support the high friction member 139*a* with a higher support force at positions downstream with respect to the guide direction A than at positions upstream with respect to the guide direction A. That is, assuming that all the resilient cantilevers 139*a* have the same flexural rigidity which equals Young's modulus multiplied by second moment of inertia, then the longer the resilient cantilever 139*a*, the more its tip will bend downward under the same load. Therefore, the upper surface of the high-friction separation member 131 will greatly sink at portions that correspond to the sheets P that are nearer the slanting plate 12 so that these sheets P abut against the upper surface of the fixed separation plate 15. On the other hand, the upper surface of the high-friction separation member 131 that corresponds to the shorter resilient cantilevers 139*a* will protrude upward above the upper surface of the fixed separation plate 15 so that the sheets P farthest from the slanting plate 12 abut against the upper surface of the high-friction separation member 131. A sufficient friction resistance between the lower edge of the sheets P and the separation surface of the high-friction separation member 131 can be achieved for preventing the sheet P from being slidingly moved in the guide direction A.

Figure 14:
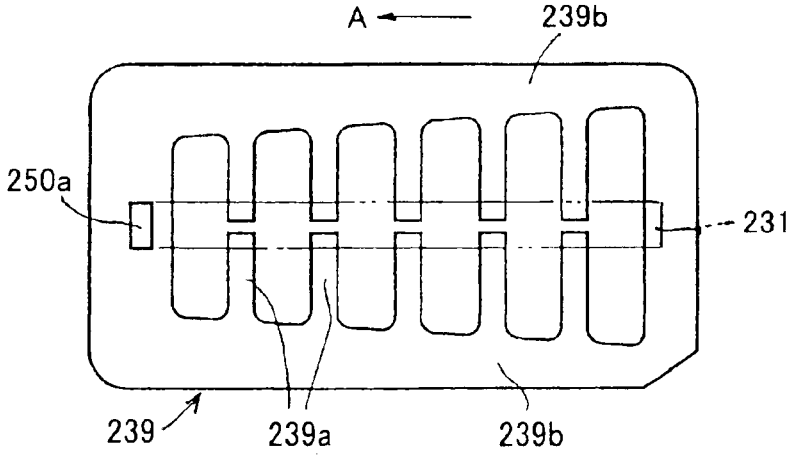
FIG. 14 is a plan view showing a resilient support plate according to a third embodiment of the present invention.

A resilient support plate 239 according to a third embodiment of the present invention will be described with reference to FIG. 14. The resilient support plate 239 includes an outer peripheral frame 239*b* having a substantially rectangular shape as viewed in plan and resilient cantilevers 239*a* disposed on left and right side inner peripheral edges of the outer peripheral frame 239*b*. The resilient cantilevers 239*a* are separated from each other by a suitable spacing in the guide direction A. The resilient cantilevers 239*a* extend so that their tip ends face each other and moreover so that corresponding tip ends of left and right side resilient cantilevers 239*a* confront each other. Also, the resilient cantilevers 239*a* at the upstream end of the outer peripheral frame 239*b* with respect to the guide direction A are formed longer than those at the downstream end. Said differently, the resilient cantilevers 239*a* nearer the slanting plate 12 are longer. The cantilevers 239*a* are gradually shorter with distance downstream. The outer peripheral frame 239*b* is formed with an engagement hole 250*a*. A high-friction separation member 231 is mounted in the engagement hole 250*a* and supported on the free ends of the cantilevers 139*a*.

With this configuration, less twist or distortion is generated than with the configuration of the first embodiment. It should be noted that if the resilient cantilevers 239*a* are expected to be resiliently bent by a large amount, then the tip ends of the resilient cantilevers 239*a* need to be incorporated deeper into the sides of the high-friction separation member 231 so as to prevent the tip ends of the resilient cantilevers 239*a* from being pulled out from the high-friction separation member 231.

Figure 15:
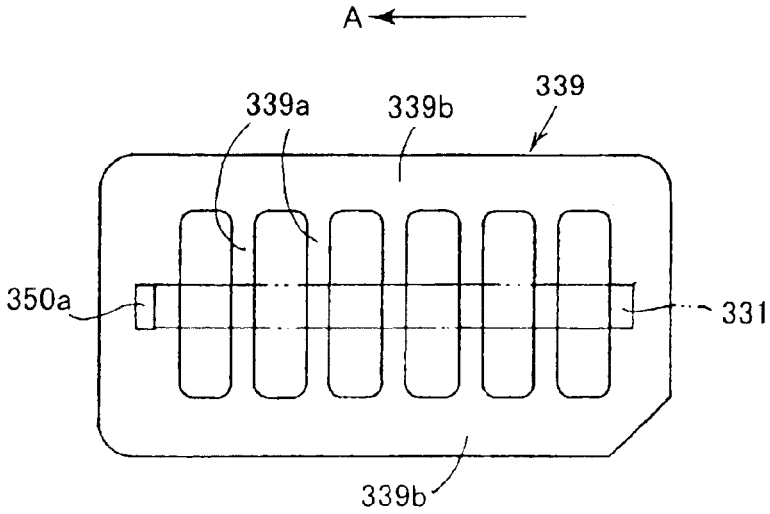
FIG. 15 is a plan view showing a resilient support plate according to a fourth embodiment of the present invention.

Next, a resilient support plate 339 according to a fourth embodiment of the present invention will be described with reference to FIG. 15. The resilient support plate 339 includes resilient crossbeams 339*a* and an outer peripheral frame 339*b*. The outer peripheral frame 339*b* has a substantially rectangular frame shape in plan. The resilient cross-beams 339*a* extend from the inner peripheral edges of the frame shaped outer peripheral frame 339*b* and are separated by a suitable spacing in the guide direction A. Each of the resilient crossbeams 339*a* of the fourth embodiment is continuous at its central portion and is supported at both ends on the outer peripheral frame 339*b*. The outer peripheral frame 339*b* is formed with an engagement hole 350*a*. A high-friction separation member 331 is engaged in the engagement hole 350*a*. The high-friction separation member 331 is connected to and supported across the center portions of the resilient crossbeams 339*a*. The high-friction separation member 331 is elongated following the guide direction A. It should be noted that cantilevers have an advantage over crossbeams in that they are capable of bending to a greater extent because one end is free. Therefore, the high friction member can sink more deeply downward when supported by cantilevers than crossbeams. Still however, the cross-beam arrangement can be deformed to a desired level by suitably selecting dimension of the cross-beam and material of the support plate 339.

Figure 16:
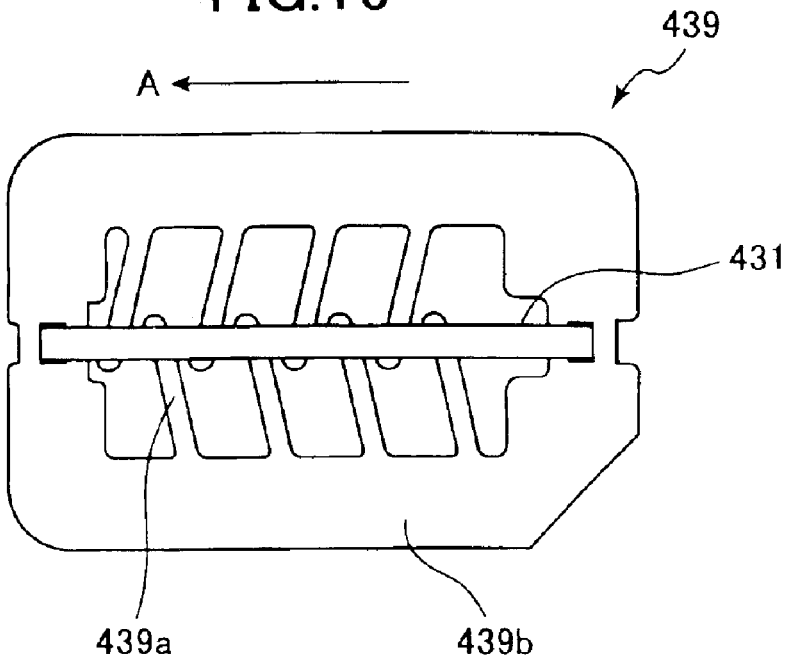
FIG. 16 is a plan view showing a resilient support plate according to a fifth embodiment of the present invention.

Next, a resilient support plate 439 according to a fifth embodiment of the present invention will be described with reference to FIG. 16. The resilient support plate 439 includes an outer peripheral frame 439*b* and a plurality of resilient cantilevers 439*a*. The cantilevers 439*a* have a staggered configuration similar to that of the cantilevers 39*a*, wherein the free ends of the cantilevers 439*a* from opposite long sides of the outer peripheral frame 439*b* extend in between each other. However, according to the fifth embodiment, the cantilevers 439*a* extend slantingly downstream with respect to the guide direction A. Also, as in the first embodiment, the resilient cantilever 439*a* nearest the downstream end of the outer peripheral frame 439*b* is separated from the downstream end of the outer peripheral frame 439*b* by a shorter distance than the resilient cantilever 439*a* nearest the upstream end of the outer peripheral frame 439*b* is separated from the upstream end of the outer peripheral frame 439*b*. Alternatively, a pitch between the neighboring resilient cantilevers 439*a* can be gradually reduced toward the downstream side. Further, a high friction separation member 431 has downstream and upstream ends supported by the downstream and upstream end portions of the outer peripheral frame 439*b*.

Figure 17:
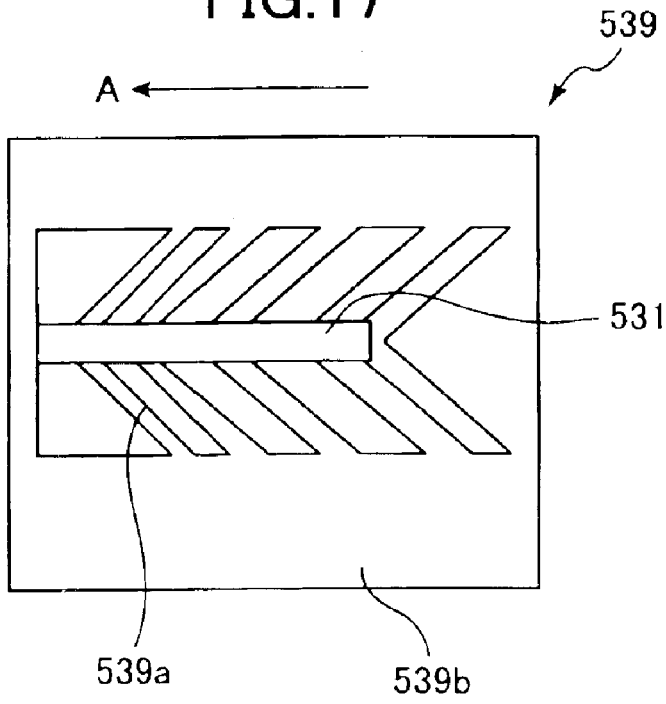
FIG. 17 is a plan view showing a resilient support plate according to a sixth embodiment of the present invention.

Next, a resilient support plate 539 according to a sixth embodiment of the present invention will be described with reference to FIG. 17. The resilient support plate 539 includes an outer peripheral frame 539*b* and a plurality of resilient crossbeams 539*a*. Each resilient crossbeam 539*a* has an angled V-shape with a vertex facing downstream with respect to the guide direction A. A high-friction separation member 531 is connected to and supported across the central vertexes of the resilient crossbeams 539*a*. The high-friction separation member 531 is elongated following the guide direction A. The resilient support plate 539 more stably supports the weight of the stack of sheets P. Further, because the crossbeams 539*a* are supported at both ends on the outer peripheral frame 539*b*, deformation amount of the crossbeams 539*a* is restricted. Twisting movement of the resilient support plate 539 can be prevented. Also, as in the first embodiment, the resilient cantilever 539*a* nearest the downstream end of the outer peripheral frame 539*b* is separated from the downstream end of the outer peripheral frame 539*b* by a shorter distance than the resilient cantilever 539*a* nearest the upstream end of the outer peripheral frame 539*b* is separated from the upstream end of the outer peripheral frame 539*b*. Alternatively, a pitch between the neighboring resilient cantilevers 439*a* can be gradually reduced toward the downstream side.

Because the resilient support plates of all the embodiments include slats, whether cantilevers or crossbeams, that extend in a direction that intersects the guide direction A, only the slats located near pressing force from the sheets will deform when the sheets press against only certain portions of the elongated high friction member. The high friction member will sink downward from the upper surface of the fixed separation plate 15 at these locations only. Accordingly the high friction member will have good response to load or pressing force so that sheets can be consistently separated one at a time. Further, because the multi-function image forming device 1 includes the image forming device 10, sheets are supplied to the image forming unit one at a time so that sheets will be reliably printed on with desired images.

While the invention has been described in detail with reference to specific embodiments thereof, it would be apparent to those skilled in the art that various changes and modifications may be made therein without departing from the spirit and scope of the invention.

For example, in the above-described embodiments, the pair of left and right guide plates 13*a*, 13*a* guide the sheets P so that the widthwise center of the lower edge the sheets P abuts against the high-friction separation member 31, regardless of the horizontal size (width) of the sheets P. However, the exact widthwise center of the lower edge need not abut against the high-friction separation member 31. The same effects can be achieved as long as a position near the center of the lower edge abuts against the high-friction separation member 31, even if there is some shift to the left or right. Accordingly, the present invention can be used in a sheet-supply device for supplying sheets P using either the left or right edge of the sheet P as a reference.

Of course, the separation operation will operate smoothly as long as the high-friction separation member 31 is near the linear sheet-supply force Q of the sheet-supply roller 21, even if the high-friction separation member 31 is slightly shifted from the extension of the linear sheet-supply force Q.

Further, in the embodiments, the slanting plate 12 of the sheet-supply device 10 is disposed with a slanted posture. Below this, the fixed separation plate 15, the first movable separation plate 32*a* (32*b*) and the second movable separation plates 33*a* (33*b*) are disposed with a posture slanted in the guide direction A. However, the present invention can be applied to a sheet-supply device wherein the slanting plate is disposed in a substantially horizontal posture and the fixed separation plate 15 and the movable separation members 32*a* to 33*b* are disposed with a posture for guiding sheets upward from the slanting surface.

In the second and third embodiments, cantilevers farther downstream with respect to the guide direction A support the high friction member with a higher support force. However, the support force of slats (whether cantilevers or cross beams) can be adjusted in any of a variety of ways so that slats farther downstream with respect to the guide direction A support the high friction member with a higher support force. For example, as mentioned previously the support force can be adjusted by changing the thickness or material of the spring plate of the resilient support plate, or changing the length or modulus of section of the resilient cantilevers, pitches of the cantilevers, etc.

What is claimed is:

1. A sheet-supply device for supplying sheets one at a time from a stack of sheets in a sheet feeding direction, the sheet-supply device comprising:

a sheet supporting member that supports the stack of sheets;

a sheet feed unit applying a force to a sheet in the stack to move the sheet in the sheet feed direction;

a guide member disposed at a downstream side of the sheet supporting member with respect to the sheet feed direction, the guide member having a guide surface that guides the sheet in a guide direction;

a high friction member extending in the guide direction and disposed in the guide member, the high friction member having a separation surface exposed through the guide surface so that the stack of sheets supported by the sheet supporting member abuts against the separation surface; and a resilient support member supporting the high friction member and allowing the separation surface to protrude from and retract into the guide surface depending on the force provided by the sheet feed unit, wherein the separation surface retracts into the guide surface by elastic deformation of the high friction member and the resilient support member in response to the force.

2. The sheet-supply device as claimed in claim 1, wherein the high friction member has a downstream edge with respect to the guide direction, the downstream edge slanting away from the separation surface of the high friction member in the guide direction.

3. A sheet-supply device for supplying sheets one at a time from a stack of sheets in a sheet feeding direction, the sheet-supply device comprising:

a sheet supporting member that supports the stack of sheets;

a sheet feed unit applying a force to a sheet in the stack to move the sheet in the sheet feed direction;

a guide member disposed at a downstream side of the sheet supporting member with respect to the sheet feed direction, the guide member having a guide surface that guides the sheet in a guide direction;

a high friction member extending in the guide direction and disposed in the guide member, the high friction member having a separation surface exposed through the guide surface so that the stack of sheets supported by the sheet supporting member abuts against the separation surface; and a resilient support member supporting the high friction member and allowing the separation surface to protrude from and retract into the guide surface depending on a force provided by the sheet feed unit, the resilient support member including:

a base plate; and a plurality of resilient slats that extend from the base plate in a direction that intersects the guide direction, each resilient slat supporting the high friction member at a position separated from the base plate.

4. The sheet-supply device as claimed in claim 3, wherein the plurality of resilient slats provides a support force for supporting the high friction member, the support force being increasing toward a downstream side in the guide direction.

5. The sheet-supply device as claimed in claim 4, wherein numbers of slats per unit distance at a downstream area in the guide direction of the resilient support member are greater than numbers of slats per unit distance at an up-stream area of the resilient support member.

6. The sheet-supply device as claimed in claim 3, wherein the base plate of the resilient support member includes a first side and a second side that extend substantially in the guide direction, the first and second sides having a first inner surface and a second inner surface respectively, the first and second inner surfaces substantially facing each other; and the resilient slats including a first set of cantilevers and a second set of cantilevers, the first set of the cantilevers protruding from the first inner surface toward the second inner surface, the second set of the cantilevers protruding from the second inner surface toward the first inner surface.

7. The sheet-supply device as claimed in claim 6, wherein the high friction member has an elongated shape having a first side surface facing the first inner surface of the base plate and a second side surface facing the second inner surface of the base plate, and wherein the first set of cantilevers has free ends penetrating into the first side surface of the high friction member, and the second set of cantilevers has free ends penetrating into the second side surface of the high friction member.

8. The sheet-supply device as claimed in claim 7, wherein the cantilevers provide a staggered configuration wherein the free ends of the first and second sets extend in between each other.

9. The sheet-supply device as claimed in claim 8, wherein the cantilevers extend perpendicular to the guide direction, the cantilevers supporting the high friction member at positions separated from the base plate by substantially the same distance.

10. The sheet-supply device as claimed in claim 8, wherein the cantilevers extend in a direction substantially perpendicular to the guide direction, cantilevers that are located farther upstream in the guide direction support the high friction member at positions separated farther from the base plate than positions where cantilevers that are located downstream in the guide direction support the high friction member.

11. The sheet-supply device as claimed in claim 8, wherein the cantilevers extend slantingly downstream with respect to the guide direction.

12. The sheet-supply device as claimed in claim 7, wherein each of the cantilevers has a base end and a free end, the base end of each cantilever being connected with the base plate, the free end of each cantilever penetrating at least partially through the high friction member, the cantilevers being juxtaposed so that the free ends of the first and second sets extend substantially into confrontation with each other.

13. The sheet-supply device as claimed in claim 12, wherein the cantilevers extend in a direction substantially perpendicular to the guide direction, cantilevers that are located farther upstream in the guide direction supporting the high friction member at positions separated farther from the base plate than positions where cantilevers that are located downstream in the guide direction support the high friction member.

14. The sheet-supply device as claimed in claim 3, wherein the base plate of the resilient support member includes a first side and a second side that extend substantially in the guide direction, the first and second sides having a first inner surface and a second inner surface respectively, the first and second inner surfaces substantially facing each other; and wherein the slats extend integrally between the inner surfaces of the base plate in a direction that intersects the guide direction, the slats penetrating through and supporting the high friction member.

15. The sheet-supply device as claimed in claim 14, wherein each slat has an angled shape with a vertex facing downstream with respect to the guide direction.

16. The sheet-supply device as claimed in claim 3, further comprising a base block disposed on an opposite side of the resilient support plate than the guide member, the base block being formed with an indentation at a position corresponding to the slats so that the base block supports only the base plate of the resilient support member.

17. The sheet-supply device as claimed in claim 3, wherein the high friction member includes thick portions where the slats support the friction member and thin portions between the thick portions.

18. A sheet-supply device for supplying sheets one at a time from a stack of sheets in a sheet feeding direction, the sheet-supply device comprising:

a sheet supporting member that supports the stack of sheets;

a sheet feed unit applying a force to a sheet in the stack to move the sheet in the sheet feed direction;

a guide member disposed at a downstream side of the sheet supporting member with respect to the sheet feed direction, the guide member having a guide surface that guides the sheet in a guide direction;

a high friction member extending in the guide direction and disposed in the guide member, the high friction member having a separation surface exposed through the guide surface so that the stack of sheets supported by the sheet supporting member abuts against the separation surface; and a resilient support member supporting the high friction member and allowing the separation surface to protrude from and retract into the guide surface depending on a force provided by the sheet feed unit, wherein the separation surface of the high friction member is formed with teeth that form a saw-toothed contour on the separation surface, each tooth having an upstream side, a downstream side, and an apex between the upstream side and the downstream side, the apexes of the teeth being deviated toward upstream with respect to the guide direction so that the upstream sides have a steeper rising edge angle than the downstream sides.

19. A sheet-supply device for supplying sheets one at a time from a stack of sheets in a sheet feeding direction, the sheet-supply device comprising:

a sheet supporting member that supports the stack of sheets;

a sheet feed unit applying a force to a sheet in the stack to move the sheet in the sheet feed direction;

a guide member disposed at a downstream side of the sheet supporting member with respect to the sheet feed direction, the guide member having a guide surface that guides the sheet in a guide direction, the guide member including:

a fixed separation plate provided at a widthwise center of the sheet sup-porting member and positioned in alignment with the sheet feed unit, the fixed separation plate having a fixed guide surface, and the high friction member being provided in the fixed separation plate;

a pair of first movable separation plates positioned laterally beside the fixed separation plate, the pair of first movable separation plates being pivotally movably supported to be pivotally movable away from the guide direction and having a pair of first guide surfaces; and a pair of second movable separation plates positioned laterally beside the pair of first movable separation plates, the pair of second movable separation plates being pivotally movably supported to be pivotally movable away from the guide direction and having a pair of second guide surfaces;

a high friction member extending in the guide direction and disposed in the guide member, the high friction member having a separation surface exposed through the guide surface so that the stack of sheets supported by the sheet supporting member abuts against the separation surface; and a resilient support member supporting the high friction member and allowing the separation surface to protrude from and retract into the guide surface depending on a force provided by the sheet feed unit.

20. The sheet-supply device as claimed in claim 19, wherein a combination of the fixed guide surface, the pair of first guide surfaces and the pair of second guide surfaces is shaped into upwardly protruding convex shape.

21. The sheet-supply device as claimed in claim 19, wherein the pair of first movable separation plates and the pair of second movable separation plates have base ends at positions adjacent the sheet supporting member and free ends positioned away from the sheet supporting member, and the sheet-supply device further comprising a plurality of biasing members each biasing respective the first movable separation plates and the second movable separation plates so that their free ends are directed toward the sheet feed direction.

22. The sheet-supply device as claimed in claim 19, wherein each of the first movable separation plates is formed with a first engagement rib protruding horizontally toward the adjacent one of the second movable separation plate, and each of the second movable separation plates is formed with a second engagement rib protruding horizontally toward the adjacent one of the first movable separation plate, so that the second engagement ribs are positioned immediately above the first engagement ribs.

23. An image forming device comprising:

a sheet-supply device for supplying sheets one at a time from a stack of sheets in a sheet feeding direction, the sheet-supply device comprising:

a sheet supporting member that supports the stack of sheets;

a sheet feed unit applying a force to a sheet in the stack to move the sheet in the sheet feed direction;

a guide member disposed at a downstream side of the sheet supporting member with respect to the sheet feed direction, the guide member having a guide surface that guides the sheet in a guide direction different from the sheet feed direction;

a high friction member extending in the guide direction and disposed in the guide member, the high friction member having a separation surface exposed through the guide surface so that the stack of sheets supported by the sheet supporting member abuts against the separation surface; and a resilient support member supporting the high friction member and allowing the separation surface to protrude from and retract into the guide surface depending on the force provided by the sheet feed unit; and an image forming portion disposed downstream of the sheet-supply device in the sheet feeding direction for forming images on the sheets supplied by the sheet-supply device.

* * * * *